US009849495B2

(12) United States Patent
Sakane et al.

(10) Patent No.: US 9,849,495 B2
(45) Date of Patent: Dec. 26, 2017

(54) SPINNING THICKENING FORMING METHOD AND SPINNING THICKENING FORMING APPARATUS

(71) Applicant: KAWASAKI JUKOGYO KABUSHIKI KAISHA, Kobe-shi, Hyogo (JP)

(72) Inventors: Yuto Sakane, Kobe (JP); Yoshihide Imamura, Kobe (JP); Kohei Mikami, Akashi (JP); Hayato Iwasaki, Kobe (JP); Hideyuki Ogishi, Akashi (JP); Hiroshi Kitano, Kobe (JP)

(73) Assignee: KAWASAKI JUKOGYO KABUSHIKI KAISHA, Kobe-Shi (JP)

( * ) Notice: Subject to any disclaimer, the term of this patent is extended or adjusted under 35 U.S.C. 154(b) by 57 days.

(21) Appl. No.: 14/895,426

(22) PCT Filed: May 9, 2014

(86) PCT No.: PCT/JP2014/002454

§ 371 (c)(1),
(2) Date: Dec. 2, 2015

(87) PCT Pub. No.: WO2014/196127

PCT Pub. Date: Dec. 11, 2014

(65) Prior Publication Data

US 2016/0101455 A1 Apr. 14, 2016

(30) Foreign Application Priority Data

Jun. 4, 2013 (JP) ..... 2013-117644

(51) Int. Cl.
*B21D 22/14* (2006.01)
*H05B 6/10* (2006.01)
(Continued)

(52) U.S. Cl.
CPC ..... *B21D 22/14* (2013.01); *B21D 53/261* (2013.01); *B21D 53/28* (2013.01); *H05B 6/102* (2013.01)

(58) Field of Classification Search
CPC ..... B21D 22/14; B21D 22/16; B21D 22/18; B21D 37/16; B21D 53/261; B21D 53/28; H05B 6/102
See application file for complete search history.

(56) References Cited

U.S. PATENT DOCUMENTS 438,406 A * 10/1890 Dewey ..... B21D 22/16 219/149
3,815,395 A * 6/1974 Sass ..... B21D 22/18 72/342.1

(Continued)

FOREIGN PATENT DOCUMENTS

CN 202070632 U 12/2011
DE 199 16 280 A1 8/2000

(Continued)

OTHER PUBLICATIONS

Jan. 22, 2017 Office Action issued in Chinese Patent Application No. 201480025993.6.

(Continued)

*Primary Examiner* — Edward Tolan
(74) *Attorney, Agent, or Firm* — Oliff PLC

(57) ABSTRACT

A spinning thickening forming method is a method of, while rotating a plate including a center portion fixed to a fixing jig, increasing a thickness of a peripheral portion of the plate. Specifically, while locally heating the peripheral portion of the plate such that at least a portion of the plate which is adjacent to the fixing jig maintains stiffness, a forming roller is pressed against the peripheral portion of the plate to compress the peripheral portion in at least a direction (Continued)

perpendicular to a thickness direction of the peripheral portion.

8 Claims, 9 Drawing Sheets

(51) Int. Cl.
*B21D 53/26* (2006.01)
*B21D 53/28* (2006.01)

(56) References Cited

U.S. PATENT DOCUMENTS

| | | | | |
|---|---|---|---|---|
| 4,606,206 | A | 8/1986 | Daudi | |
| 5,388,964 | A | 2/1995 | Ciokajlo et al. | |
| 5,562,785 | A | 10/1996 | Yamanaka | |
| 5,722,138 | A | 3/1998 | Yamanaka | |
| 5,809,649 | A | 9/1998 | Kostermeier | |
| 5,826,452 | A | 10/1998 | Reichhardt | |
| 6,223,576 | B1 | 5/2001 | Mashita | |
| 6,226,576 | B1 | 5/2001 | Torno et al. | |
| 7,047,781 | B1 * | 5/2006 | Kanemitsu | B21H 1/04 72/110 |
| 8,959,975 | B2 * | 2/2015 | Welser | B21D 5/08 72/110 |
| 2004/0134249 | A1 * | 7/2004 | Utiashev | B21D 22/16 72/69 |
| 2015/0089986 | A1 * | 4/2015 | Nillies | B21D 22/14 72/68 |
| 2015/0202677 | A1 | 7/2015 | Ogishi et al. | |

FOREIGN PATENT DOCUMENTS

| | | | |
|---|---|---|---|
| JP | H09-66330 | A | 3/1991 |
| JP | H06-182471 | A | 7/1994 |
| JP | H07-166960 | A | 6/1995 |
| JP | H07-290181 | A | 11/1995 |
| JP | H10-5912 | A | 1/1998 |
| JP | H11-739 | A | 1/1999 |
| JP | 2000-197941 | A | 7/2000 |
| JP | 2000-205273 | A | 7/2000 |
| JP | 2001-129635 | A | 5/2001 |
| JP | 2004-337906 | A | 12/2004 |
| JP | 2005-028422 | A | 2/2005 |
| JP | 2012-192414 | A | 10/2012 |
| JP | 2012-234671 | A | 11/2012 |
| WO | 2014/024384 | A1 | 2/2014 |

OTHER PUBLICATIONS

U.S. Appl. No. 15/305,848, filed Oct. 21, 2016 in the name of Yoshihide Imamura et al.
Aug. 5, 2014 Search Report issued in International Patent Application No. PCT/JP2014/002454.
Aug. 4, 2014 Search Report issued in International Patent Application No. PCT/JP2014/002454.
May 19, 2015 Search Report issued in International Patent Application No. PCT/JP2015/001968.
Aug. 5, 2014 Written Opinion issued in International Patent Application No. PCT/JP2014/002454.
Dec. 8, 2015 International Preliminary Report issued in International Patent Application No. PCT/JP2014/002454.
Jun. 3, 2016 Office Action issued in Chinese Patent Application No. 201480025993.6.
Jun. 14, 2017 Office Action issued in Taiwanese Patent Application No. 104112049.

* cited by examiner

SPINNING THICKENING FORMING METHOD AND SPINNING THICKENING FORMING APPARATUS

TECHNICAL FIELD

The present invention relates to a spinning thickening forming method of increasing a thickness of a peripheral portion of a plate while rotating the plate and a spinning thickening forming apparatus suitable for the spinning thickening forming method.

BACKGROUND ART

Spinning forming is typically utilized for ironing or drawing but is sometimes used as a method of increasing a thickness of a peripheral portion of a plate. For example, as shown in FIG. 9, PTL 1 discloses a method of sandwiching a plate 100 between a fixing base 110 and a pressing plate 120; and increasing the thickness of an overhanging portion 101 of the plate 100 while rotating the plate 100, the overhanging portion 101 overhanging from the fixing base 110 and the pressing plate 120.

According to the method disclosed in PTL 1, the fixing base 110 and the pressing plate 120 also serve as a die for a thickened shape. Specifically, the fixing base 110 and the pressing plate 120 are about the same in size as each other, and a tapered surface which decreases in diameter toward the plate 100 is formed at each of an upper portion of a side surface of the fixing base 110 and a lower portion of a side surface of the pressing plate 120.

According to the method disclosed in PTL 1, first, the entire overhanging portion 101 of the plate 100 is heated by a high-frequency heater. Then, a swaging die 130 including a forming groove having a substantially triangular cross section compresses the overhanging portion 101 until the swaging die 130 contacts the fixing base 110 and the pressing plate 120. With this, the overhanging portion 101 is formed to have an arrowhead-shaped cross section. According to the other drawings of PTL 1, the swaging die 130 is presumed to be a roller which rotates following the plate 100.

CITATION LIST

Patent Literature

PTL 1: Japanese Laid-Open Patent Application Publication No. 7-290181

SUMMARY OF INVENTION

Technical Problem

However, to use the fixing base 110 and the pressing plate 120 as the die for the thickened shape, the fixing base 110 and the pressing plate 120 need to be the same in size as each other, and the fixing base 110 and the pressing plate 120 need to be produced with a high degree of accuracy. Therefore, the cost of the forming apparatus increases.

An object of the present invention is to provide a spinning thickening forming method capable of increasing the thickness of the peripheral portion of the plate at low cost and a spinning thickening forming apparatus suitable for the forming method.

Solution to Problem

To achieve the above object, a spinning thickening forming method according to the present invention is a spinning thickening forming method of, while rotating a plate including a center portion fixed to a fixing jig, increasing a thickness of a peripheral portion of the plate, the method including, while locally heating the peripheral portion of the plate such that at least a portion of the plate which is adjacent to the fixing jig maintains stiffness, pressing a forming roller against the peripheral portion of the plate to compress the peripheral portion in at least a direction perpendicular to a thickness direction of the peripheral portion.

According to the above configuration, when locally heating the peripheral portion of the plate, a portion of the plate which maintains the stiffness remains at least in the vicinity of the fixing jig. Therefore, while enduring the pressing force of the forming roller by this stiff portion, in other words, at a position away from the fixing jig, the thickness of the peripheral portion can be increased. Therefore, a component which just has a function of being able to fix the center portion of the plate can be used as the fixing jig. Therefore, the cost of the forming apparatus can be reduced.

For example, the peripheral portion of the plate may be heated by high-frequency induction heating.

The heating by the high-frequency induction heating may be performed by using a heater including: a doubled circular-arc coil portion extending along the peripheral portion of the plate; and a core including a groove in which the coil portion is fitted, and covering the coil portion from an opposite side of the peripheral portion of the plate. According to this configuration, the magnetic flux can be concentrated on the peripheral portion of the plate, so that the peripheral portion can be efficiently heated.

The forming roller may be pressed against the peripheral portion of the plate in a state where a rotation axis direction of the forming roller is in parallel with the thickness direction of the peripheral portion of the plate. According to this configuration, excessive load can be prevented from being applied to the bearings rotatably supporting the forming roller.

The forming roller may include: a cylindrical pressing surface extending in the rotation axis direction of the forming roller; and a guide surface rising from at least one of end portions of the pressing surface. According to this configuration, an end surface parallel to the thickness direction of the peripheral portion of the plate can be formed by the cylindrical pressing surface, and the expansion of the peripheral portion in the thickness direction by the compressing can be restricted by the guide surface.

The forming roller may be pressed against the peripheral portion of the plate in a pressing direction which is inclined relative to a direction perpendicular to the thickness direction of the peripheral portion of the plate, and the guide surface may be provided at one of the end portions of the pressing surface so as to form an obtuse angle together with the pressing surface, the one of the end portions being opposite to the other end portion located at a side toward which the pressing direction is inclined. This configuration is preferable when the peripheral portion of the plate is formed so as to expand toward one side along the thickness direction.

The plate may be made of a titanium alloy. In the case of the steel, the aluminum alloy, or the like, the yield strength (stress at which plastic deformation starts) gradually decreases as the temperature increases. However, in the case of the titanium alloy, the yield strength significantly decreases in a certain temperature range. Therefore, by heating the peripheral portion of the plate at a temperature higher than the above temperature range, only a narrow range of the plate which includes the peripheral portion can be deformed.

A spinning thickening forming apparatus according to the present invention includes: a fixing jig to which a center portion of a plate is fixed; a rotating shaft to which the fixing jig is attached; a heater configured to locally heat a peripheral portion of the plate; and a forming roller configured to be pressed against the heated peripheral portion of the plate in a pressing direction inclined relative to a direction perpendicular to a thickness direction of the peripheral portion, to compress the peripheral portion in at least a direction perpendicular to the thickness direction of the peripheral portion, wherein the forming roller includes: a cylindrical pressing surface extending in a rotation axis direction of the forming roller; and a guide surface rising from one of end portions of the pressing surface so as to form an obtuse angle together with the pressing surface, the one of the end portions being opposite to the other end portion located at a side toward which the pressing direction is inclined.

Advantageous Effects of Invention

According to the present invention, the thickness of the peripheral portion of the plate can be increased at low cost.

BRIEF DESCRIPTION OF DRAWINGS

FIG. 3A shows a state before thickening forming. FIG. 3B shows a state after the thickening forming.

DESCRIPTION OF EMBODIMENTS

Figure 1:
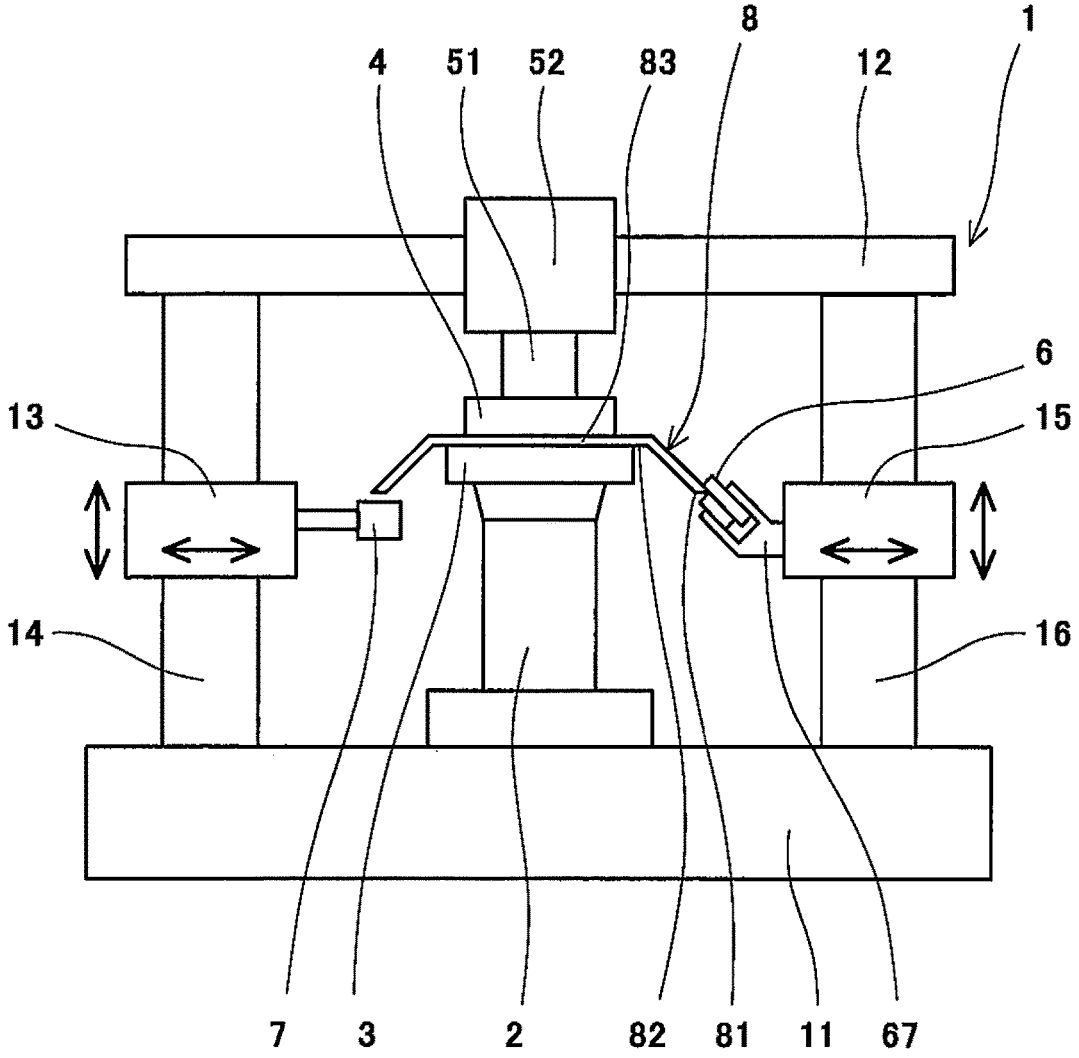
FIG. 1 is a schematic configuration diagram of a spinning thickening forming apparatus used for a spinning thickening forming method according to one embodiment of the present invention.

FIG. 1 shows a spinning thickening forming apparatus 1 used for a spinning thickening forming method according to one embodiment of the present invention. The apparatus 1 executes a method of, while rotating a plate 8 including a center portion 83 fixed to a fixing jig 3, increasing the thickness of a peripheral portion 81 of the plate 8. More specifically, while locally heating the peripheral portion 81 of the plate 8 such that at least a portion of the plate 8 which is adjacent to the fixing jig 3 maintains stiffness, the apparatus 1 presses a forming roller 6 against the peripheral portion 81 of the plate to compress the peripheral portion 81 in at least a direction perpendicular to a thickness direction of the peripheral portion 81. The plate 8 including the peripheral portion 81 which has been increased in thickness may be cut into a desired shape by machine work.

Specifically, the apparatus 1 includes: a rotating shaft 2; the fixing jig 3 attached to the rotating shaft 2; and a pressing jig 4 sandwiching the plate 8 together with the fixing jig 3. The center portion 83 of the plate 8 is fixed to the fixing jig 3. The apparatus 1 further includes: a heater 7 configured to locally heat the peripheral portion 81 of the plate 8; and the forming roller 6 configured to be pressed against the heated peripheral portion 81.

In the present embodiment, a rotation axis direction of the rotating shaft 2 corresponds to a vertical direction. However, the rotation axis direction of the rotating shaft 2 may correspond to a horizontal direction or an oblique direction. A lower portion of the rotating shaft 2 is supported by a base 11, and a motor (not shown) configured to rotate the rotating shaft 2 is arranged inside the base 11.

The shape of the plate 8 is not especially limited as long as the shape of the plate 8 is a circular shape when viewed from the rotation axis direction of the rotating shaft 2 (hereinafter simply referred to as "in a plan view"). In the present embodiment, the plate 8 has a dish shape which increases in diameter downward. However, the plate 8 may have a cup shape formed such that a peripheral wall vertically hangs down from a peripheral edge of a bottom wall. In a case where the plate 8 has the dish shape or the cup shape, the plate 8 may be fixed to the fixing jig 3 in a posture which is open upward. Or, the plate 8 may have a bowl shape which entirely curves or a flat plate shape (see FIG. 6).

In the present embodiment, the plate 8 is made of a titanium alloy. Examples of the titanium alloy include an anticorrosion alloy (for example, Ti-0.15Pd), an $\alpha$ alloy (for example, Ti-5Al-2.5Sn), an $\alpha+\beta$ alloy (for example, Ti-6Al-4V), and a $\beta$ alloy (Ti-15V-3Cr-3Sn-3Al). However, the material of the plate 8 is not limited to the titanium alloy and may be, for example, steel or an aluminum alloy.

The fixing jig 3 is, for example, a circular table which is smaller than the plate 8 in a plan view. The fixing jig 3 includes a supporting surface (in the present embodiment, an upper surface) having a shape spreading along the center portion 83 of the plate 8. To be specific, a ring-shaped portion of the plate 8 which is located around the fixing jig 3 in a plan view is a proximal portion 82 adjacent to the fixing jig 3, and the peripheral portion 81 is a distal end when viewed from the proximal portion 82. A positioning pin may be provided at a center of the supporting surface of the fixing jig 3. In this case, a through hole in which the positioning pin is fitted is provided at a center of the plate 8.

The pressing jig 4 is attached to a pressurizing rod 51 which is lifted and lowered by a lifting/lowering mechanism 52. The pressing jig 4 is pressed by the lifting/lowering mechanism 52 against the plate 8 placed on the fixing jig 3. With this, the plate 8 is fixed to the fixing jig 3. The lifting/lowering mechanism 52 is fixed to a frame 12 arranged above the rotating shaft 2. A bearing rotatably supporting the pressurizing rod 51 is incorporated in the lifting/lowering mechanism 52. The pressing jig 4 is not necessarily required, and the plate 8 may be fixed to the fixing jig 3 by screws.

For example, the heater 7 and the forming roller 6 are arranged so as to be opposed to each other across the rotating shaft 2. For example, the heater 7 is moved by a first horizontal movement mechanism 13 in a radial direction around a rotation axis of the rotating shaft 2, and the first horizontal movement mechanism 13 is moved by a first vertical movement mechanism 14 in the vertical direction. Similarly, for example, the forming roller 6 is moved by a second horizontal movement mechanism 15 in the radial direction around the rotation axis of the rotating shaft 2, and the second horizontal movement mechanism 15 is moved by a second vertical movement mechanism 16 in the vertical direction. Each of the first vertical movement mechanism 14 and the second vertical movement mechanism 16 extends so as to couple the base 11 and the frame 12.

In the present embodiment, used as the heater 7 is a heater which heats the peripheral portion 81 of the plate 8 by high-frequency induction heating. The "high-frequency induction heating" denotes induction heating whose frequency is 5 to 400 kHz. It should be noted that, for example, a gas burner may be used as the heater 7.

Figure 2A:
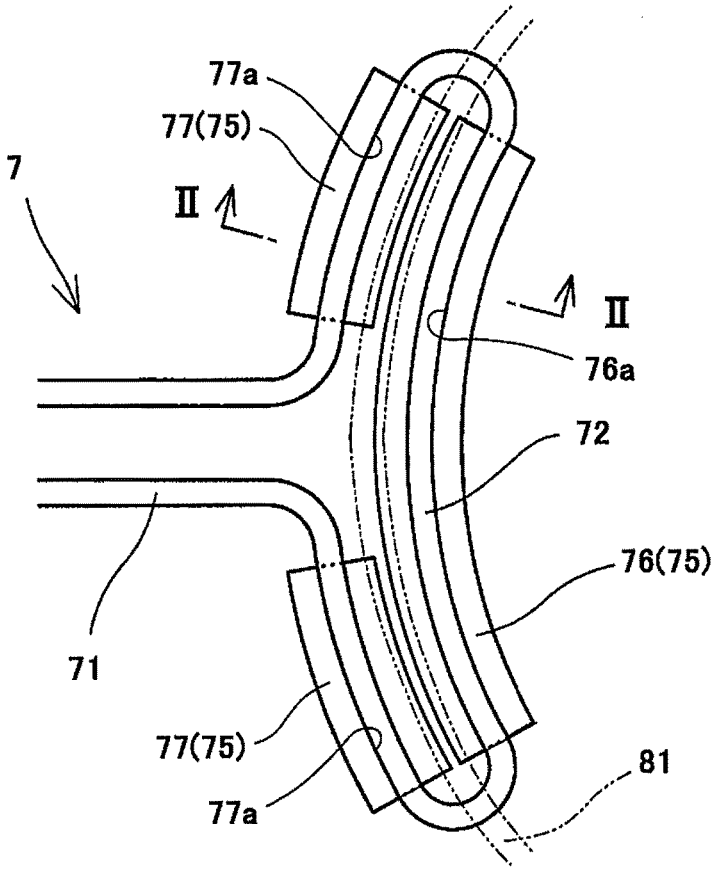
FIG. 2A is a plan view of a heater.
Figure 2B:
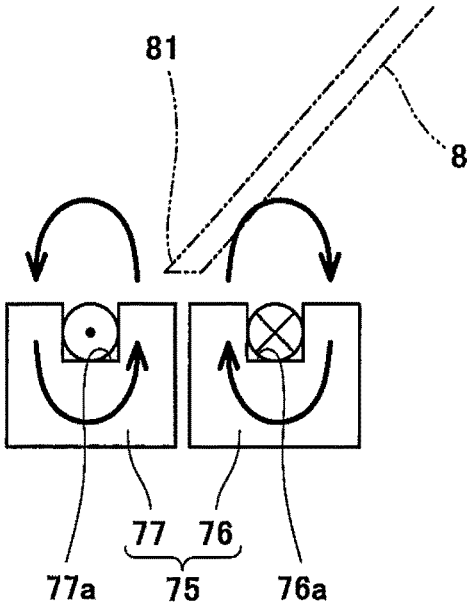
FIG. 2B is a cross-sectional view taken along line II-II of FIG. 2A.

Specifically, as shown in FIGS. 2A and 2B, the heater 7 includes: a conducting wire 71 including a coil portion 72; and a core 75 configured to collect magnetic flux generated around the coil portion 72. In the present embodiment in which the material of the plate 8 is the titanium alloy, for example, the heater 7 heats the peripheral portion 81 of the plate 8 to about 500 to 1,000° C. by a skin effect in the induction heating. The conducting wire 71 is a hollow tube in which a cooling liquid flows. For example, the temperature of the peripheral portion 81 of the plate 8 is measured, and an alternating voltage applied to the conducting wire 71 is controlled such that the measured temperature becomes a target temperature.

Figure 4A:
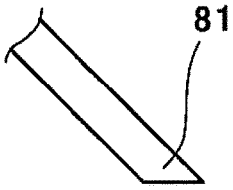
FIGS. 4A to 4D are diagrams each showing the shape of a peripheral portion of a plate.
Figure 4B:
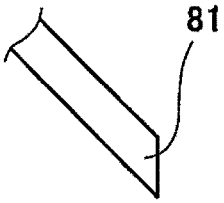
Figure 4C:
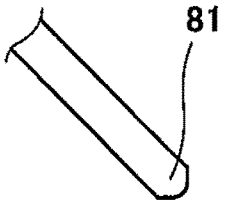
Figure 4D:
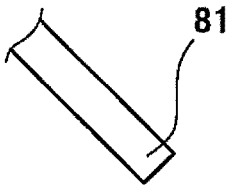

In the present embodiment, as shown in FIG. 4A, the peripheral portion 81 of the plate 8 has such a shape as to be cut in the horizontal direction. However, the peripheral portion 81 of the plate 8 may have such a shape as to be cut in the vertical direction as shown in FIG. 4B, may have such a shape that a tip end thereof is rounded as shown in FIG. 4C, or may have such a shape as to be cut in the thickness direction as shown in FIG. 4D.

The coil portion 72 has a doubled circular-arc shape extending along the peripheral portion 81 of the plate 8. In the present embodiment, since the heater 7 is arranged immediately under the peripheral portion 81 (the heater 7 heats the peripheral portion 81 from below), a direction in which two circular-arc portions of the coil portion 72 are lined up corresponds to the horizontal direction. In a case where the heater 7 is arranged immediately at a side of the peripheral portion 81 (the heater 7 heats the peripheral portion 81 from a radially outer side), the direction in which the two circular-arc portions of the coil portion 72 are lined up may correspond to the vertical direction.

The core 75 is a circular-arc member which covers the coil portion 72 from an opposite side of the peripheral portion 81 of the plate 8. A groove in which the coil portion 72 is fitted is formed on a surface (in the present embodiment, an upper surface) of the core 75, the surface facing the peripheral portion 81 of the plate 8. In the present embodiment, the core 75 is constituted by one inner peripheral piece 76 and two outer peripheral pieces 77. The inner peripheral piece 76 is provided with a groove 76*a* in which an inner circular-arc portion of the coil portion 72 is fitted. Each of the outer peripheral pieces 77 is provided with a groove 77*a* in which an outer circular-arc portion of the coil portion 72 is fitted. However, the core 75 may be configured such that the inner peripheral piece 76 and the outer peripheral pieces 77 are integrally formed via an insulator.

In the present embodiment in which the material of the plate 8 is the titanium alloy, in order to locally heat the peripheral portion 81 of the plate 8 such that at least the proximal portion 82 of the plate 8 maintains the stiffness, a distance from the fixing jig 3 to the peripheral portion 81 is only required to be secured to some extent. This is because heat conductivity of the titanium alloy is extremely low. With this, since the proximal portion 82 is maintained at a comparatively low temperature, at least the proximal portion 82 maintains the stiffness.

In a case where the material of the plate 8 is the steel or the aluminum alloy, in order to locally heat the peripheral portion 81 of the plate 8 such that at least the proximal portion 82 of the plate 8 maintains the stiffness, for example, the fixing jig 3 may be provided with a cooling means, or the other countermeasure may be taken.

Figure 3B:
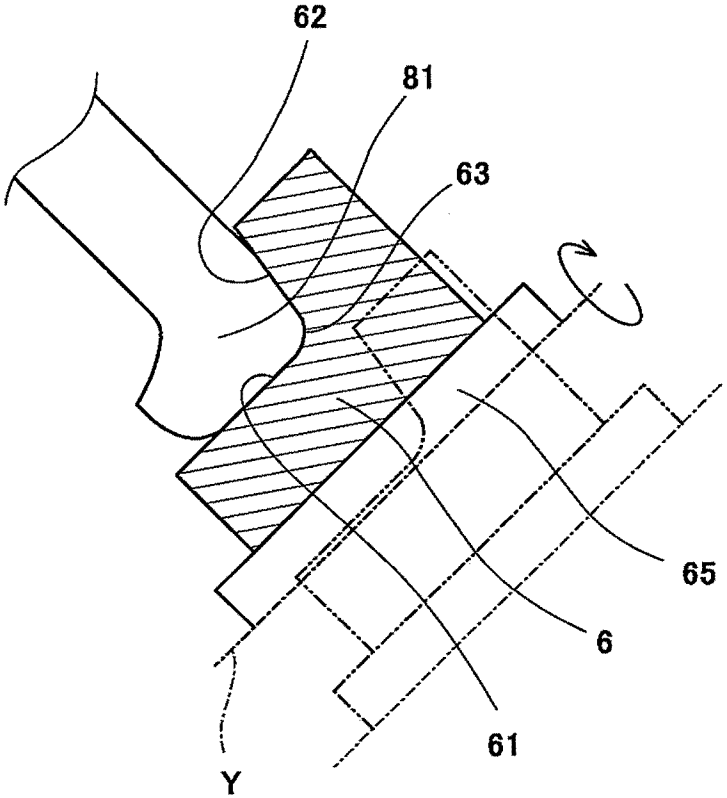
FIGS. 3A and 3B are partial cross-sectional views of a forming roller.
Figure 3A:
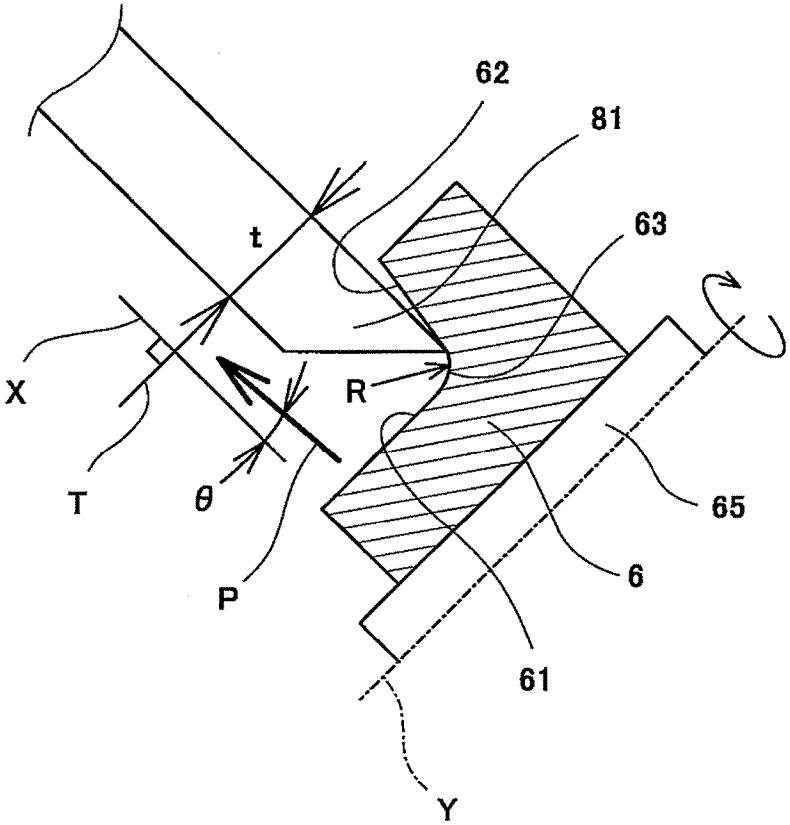

As shown in FIG. 3A, the forming roller 6 pressed against the heated peripheral portion 81 of the plate 8 includes a through hole at its center, and a shaft 65 is inserted through the through hole. A pair of bearings rotatably supporting the forming roller 6 are arranged between the shaft 65 and the through hole. In FIG. 3A, for simplicity, the forming roller 6 fits the shaft 65, and the bearings are omitted. As shown in FIG. 1, both end portions of the shaft 65 are supported by a bracket 67 (not shown in FIG. 3A) attached to the second horizontal movement mechanism 15.

A plurality of forming rollers 6 may be provided. For example, two forming rollers 6 may be arranged so as to be opposed to each other across the rotating shaft 2. In this case, the heater 7 may be arranged at a position which forms 90° together with each of the forming rollers 6 around the rotation axis of the rotating shaft 2.

Referring again to FIG. 3A, it is desirable that the forming roller 6 be pressed against the peripheral portion 81 in a state where a rotation axis direction Y of the forming roller 6 is in parallel with a thickness direction T of the peripheral portion 81. This is to prevent excessive load from being applied to the bearings rotatably supporting the forming roller 6. The rotation axis direction Y is not necessarily, completely in parallel with the thickness direction T. The rotation axis direction Y is only required to be substantially in parallel with the thickness direction T. For example, an angle of the rotation axis direction Y relative to the thickness direction T may be not more than 5°.

A pressing direction P in which the forming roller 6 is pressed against the peripheral portion 81 of the plate 8 may be in parallel with a perpendicular direction X perpendicular to the thickness direction T of the peripheral portion 81 or may be inclined relative to the perpendicular direction X. The former is preferable when the peripheral portion 81 is formed so as to expand toward both sides along the thickness direction T. The latter is preferable when the peripheral portion 81 is formed so as to expand toward one side along the thickness direction T. In the present embodiment, in order to expand the peripheral portion 81 inward, the pressing direction P is closer to a horizontal direction than the perpendicular direction X is. Since the forming roller 6 is pressed against the peripheral portion 81 in this pressing direction P, the peripheral portion 81 can be formed in a thickened shape which expands inward as shown in FIG. 3B. Of course, the peripheral portion 81 can be expanded outward.

In a case where the pressing direction P is inclined relative to the perpendicular direction X, it is desirable that an angle θ formed between the pressing direction P and the perpendicular direction X be not more than 20°. This is because if this angle θ is more than 20°, bending deformation of the peripheral portion 81 requires much force, so that large force is required to press the forming roller 6.

More specifically, the forming roller 6 includes a cylindrical pressing surface 61 and a guide surface 62. The pressing surface 61 extends in the rotation axis direction Y of the forming roller 6. The guide surface 62 rises from one of end portions of the pressing surface 61, the one of the end portions being opposite to the other end portion located at a side toward which the pressing direction P is inclined relative to the perpendicular direction X. In the present embodiment, the guide surface 62 forms an obtuse angle together with the pressing surface 61. The angle of the guide surface 62 is set such that when the forming roller 6 is pressed as shown in FIG. 3B, a radially outer end portion of the guide surface 62 is prevented from interfering with the plate 8.

A round portion 63 is formed between the pressing surface 61 and the guide surface 62. The round portion 63 smoothly couples the pressing surface 61 and the guide surface 62 to each other. In a case where the peripheral portion 81 having such a shape as to be cut in the horizontal direction is expanded inward as in the present embodiment, it is desirable that an initial contact position of a tip end of the peripheral portion 81 be within a range from a center of the round portion 63 to an end of the round portion 63, the end being located at the guide surface 62 side.

If a curvature radius R of the round portion 63 is too large, a force of pressing the forming roller 6 becomes large. If the curvature radius R of the round portion 63 is too small, the peripheral portion 81 tends to crack, wrinkle, or the like. Therefore, it is desirable that the curvature radius R of the round portion 63 be not less than t/20 and not more than t/2 where t denotes the thickness of the peripheral portion 81. For example, in a case where the thickness t is 30 mm, the curvature radius R is not less than 1.5 mm and not more than 15 mm.

As explained above, in the present embodiment, when locally heating the peripheral portion 81 of the plate 8, a portion of the plate 8 which maintains the stiffness remains at least in the vicinity of the fixing jig 3. Therefore, while enduring the pressing force of the forming roller 6 by this stiff portion, in other words, at a position away from the fixing jig 3, the thickness of the peripheral portion 81 can be increased. Therefore, a component which just has a function of being able to fix the center portion 83 of the plate 8 can be used as the fixing jig 3. Therefore, the cost of the forming apparatus 1 can be reduced.

In the present embodiment, used is the heater 7 including the core 75 which covers the coil portion 72 from the opposite side of the peripheral portion 81 of the plate 8. Therefore, the magnetic flux can be concentrated on the peripheral portion 81 of the plate 8, so that the peripheral portion 81 can be efficiently heated.

Further, in the present embodiment, an end surface parallel to the thickness direction T of the peripheral portion 81 of the plate 8 can be formed by the cylindrical pressing surface 61 of the forming roller 6, and the expansion of the peripheral portion 81 in the thickness direction T by the pressing can be restricted by the guide surface 62.

Figure 5:
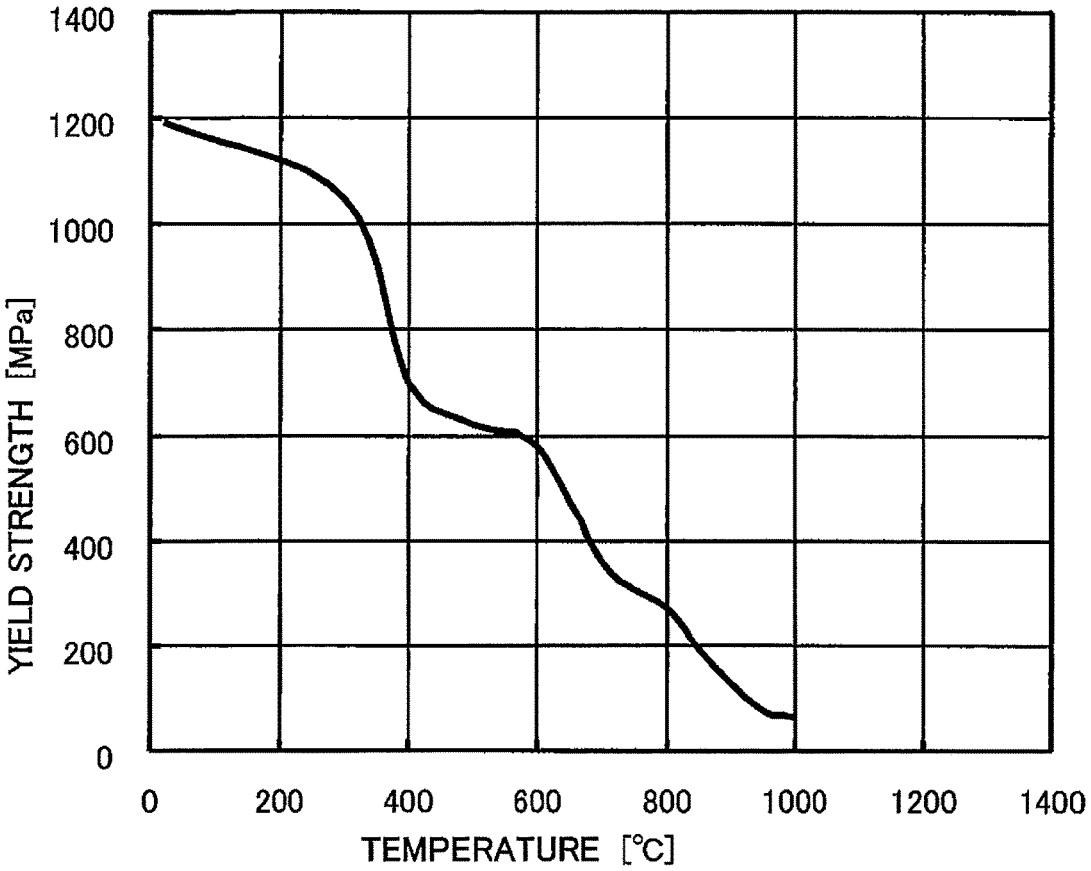
FIG. 5 is a graph showing a relation between a temperature and yield strength of Ti-6Al-4V that is a titanium alloy.

In the case of the steel, the aluminum alloy, or the like, yield strength (stress at which plastic deformation starts) gradually decreases as the temperature increases. However, in the case of the titanium alloy, as shown in FIG. 5, the yield strength significantly decreases in a certain temperature range (about 320 to 400° C.). Therefore, by heating the peripheral portion 81 of the plate 8 at a temperature higher than the above temperature range, only a narrow range including the peripheral portion 81 can be deformed.

Other Embodiments

The present invention is not limited to the above embodiment, and various modifications may be made within the scope of the present invention.

Figure 6:
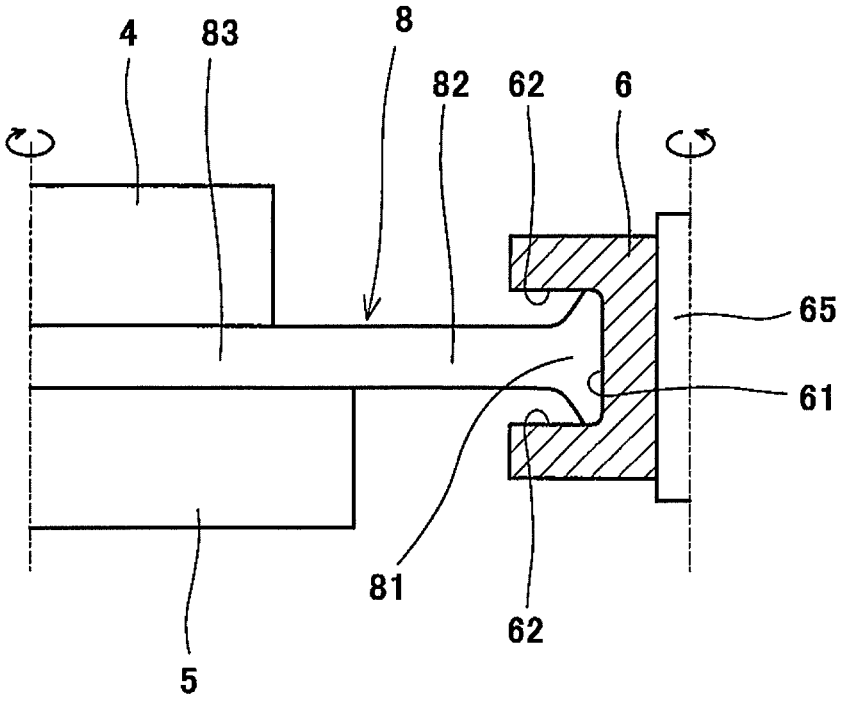
FIG. 6 is a cross-sectional view showing the forming roller and the plate according to Modification Example.

For example, the guide surface 62 is only required to rise from at least one end portion of the pressing surface 61. The angle formed between the guide surface 62 and the pressing surface 61 is not limited to the obtuse angle. For example, as shown in FIG. 6, the guide surfaces 62 may be respectively provided at both end portions of the pressing surface 61 so as to be perpendicular to the pressing surface 61.

Figure 7:
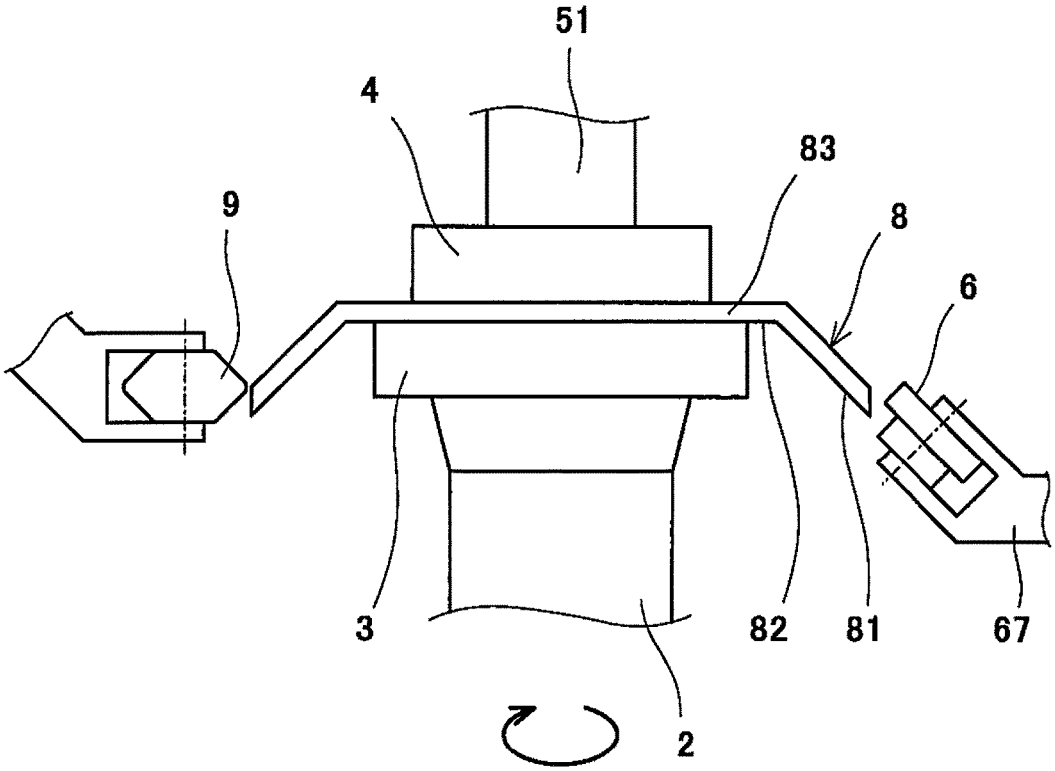
FIG. 7 is a configuration diagram of the spinning thickening forming apparatus including an auxiliary roller.
Figure 8A:
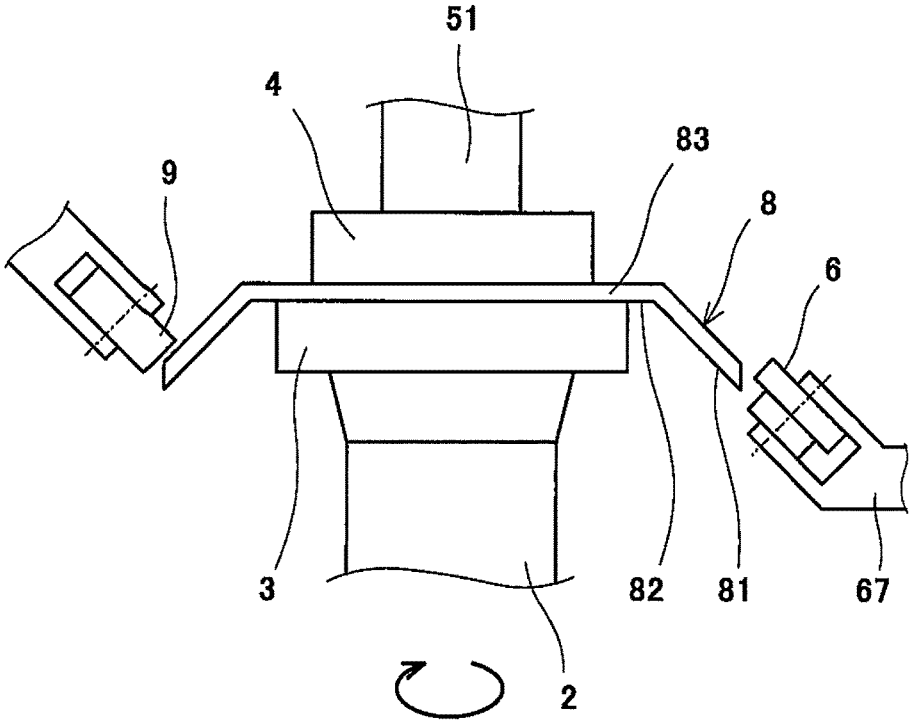
FIGS. 8A and 8B are diagrams each showing the auxiliary roller according to Modification Example.
Figure 8B:
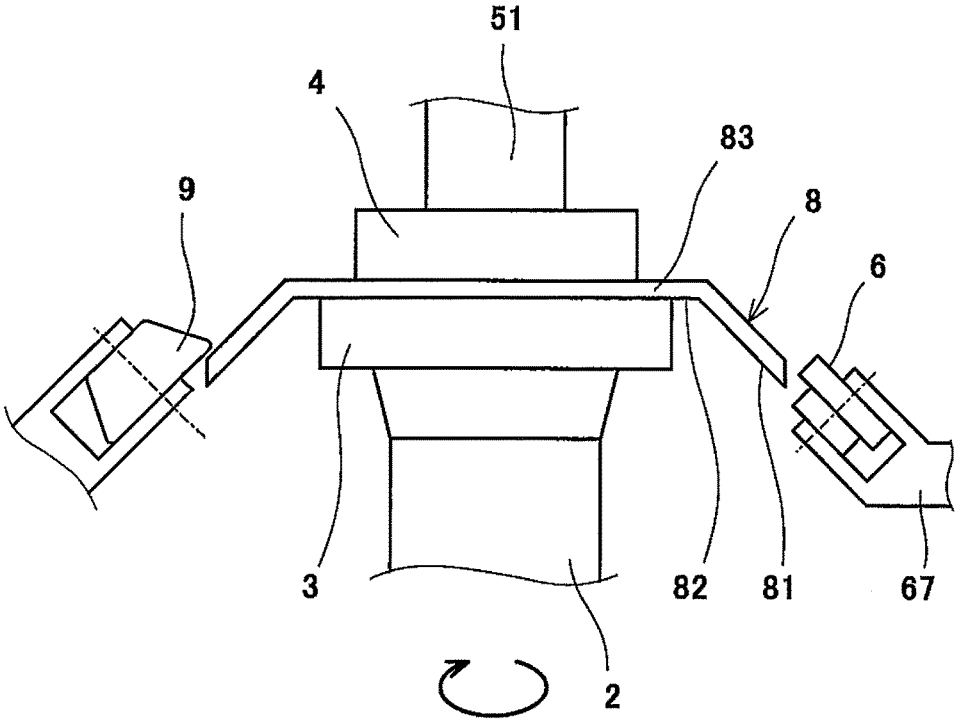
Figure 9:
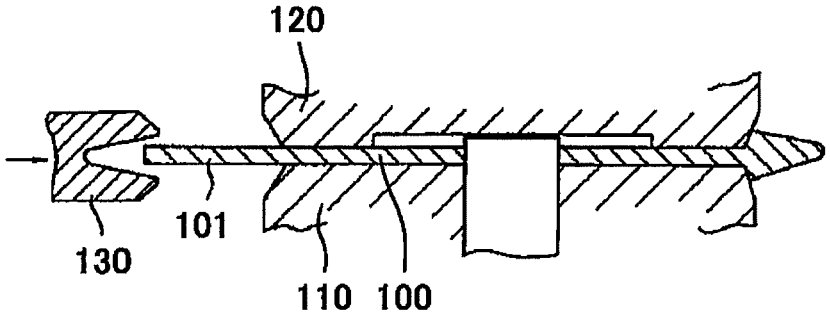
FIG. 9 is a partial cross-sectional view of a conventional spinning thickening forming apparatus.

For example, as shown in FIG. 7, in order to prevent the peripheral portion 81 of the plate 8 from moving in a radially outward direction by the pressing of the forming roller 6, an auxiliary roller 9 may be auxiliarily pressed against the peripheral portion 81 of the plate 8. As shown in FIG. 7, the auxiliary roller 9 may have such a shape that: the rotation axis direction thereof is in parallel with the vertical direction; and the cross-sectional shape of a side surface thereof is substantially an isosceles triangle. Or, as shown in FIG. 8A, the auxiliary roller 9 may have such a disc shape that the rotation axis direction thereof is perpendicular to the thickness direction of the peripheral portion 81 of the plate 8, or as shown in FIG. 8B, the auxiliary roller 9 may have a trapezoidal cross-sectional shape, and the rotation axis direction thereof is in parallel with the thickness direction of the peripheral portion 81.

INDUSTRIAL APPLICABILITY

According to the present invention, a plate having small thickness can be formed into a shape close to an actual product (near net shape), and this is useful for material cost reduction.

REFERENCE SIGNS LIST

1 spinning thickening forming apparatus
2 rotating shaft
3 fixing jig
6 forming roller
61 pressing surface
62 guide surface
7 heater
72 coil portion
75 core
75*a*, 75*b* groove
8 plate
81 peripheral portion
82 proximal portion
83 center portion

The invention claimed is:

1. A spinning thickening forming method of, while rotating a plate including a center portion fixed to a fixing jig, increasing a thickness of a peripheral portion of the plate, the method comprising while locally heating the peripheral portion of the plate such that at least an overhanging portion of the plate which is adjacent to the fixing jig maintains stiffness during an entire thickening process of the peripheral portion, wherein the overhanging portion extends from an area contacting the fixing jig toward the peripheral portion, pressing a forming roller against the peripheral portion of the plate to compress the peripheral portion in at least a direction perpendicular to a thickness direction of the peripheral portion and thereby increase the thickness of the peripheral portion at a position away from the fixing jig, wherein the entire thickening process of the peripheral portion is a period in which the forming roller is in contact with the peripheral portion and the thickness of the peripheral portion is increased, and the pressing is performed in at least a part of a period of the locally heating of the peripheral portion of the plate.

2. The spinning thickening forming method according to claim 1, wherein the peripheral portion of the plate is heated by high-frequency induction heating.

3. The spinning thickening forming method according to claim 2, wherein the heating by the high-frequency induction heating is performed by using a heater including:

a doubled circular-arc coil portion extending along the peripheral portion of the plate; and a core including a groove in which the coil portion is fitted, and covering the coil portion from an opposite side of the peripheral portion of the plate.

4. The spinning thickening forming method according to claim 1, comprising pressing the forming roller against the peripheral portion of the plate in a state where a rotation axis direction of the forming roller is in parallel with the thickness direction of the peripheral portion of the plate.

5. The spinning thickening forming method according to claim 4, wherein the forming roller includes:

a cylindrical pressing surface extending in the rotation axis direction of the forming roller; and a guide surface rising from at least one of end portions of the pressing surface.

6. The spinning thickening forming method according to claim 5, comprising pressing the forming roller against the peripheral portion of the plate in a pressing direction which is inclined relative to a direction perpendicular to the thickness direction of the peripheral portion of the plate, wherein the guide surface is provided at one of the end portions of the pressing surface so as to form an obtuse angle together with the pressing surface, the one of the end portions being opposite to the other end portion located at a side toward which the pressing direction is inclined.

7. The spinning thickening forming method according to claim 1, wherein the plate is made of a titanium alloy.

8. A spinning thickening forming apparatus comprising:

a fixing jig to which a center portion of a plate is fixed;

a rotating shaft to which the fixing jig is attached;

a heater configured to locally heat a peripheral portion of the plate; and a forming roller configured to be pressed against the heated peripheral portion of the plate in a pressing direction inclined relative to a direction perpendicular to a thickness direction of the peripheral portion, to compress the peripheral portion in at least the direction perpendicular to the thickness direction of the peripheral portion, wherein the forming roller includes:

a cylindrical pressing surface having a first pressing end and a second pressing end, the cylindrical pressing surface extending in a rotation axis direction of the forming roller; and a guide surface having a first guide end and a second guide end, the guide surface rising from the first pressing end of the pressing surface so as to form an obtuse angle between the first guide end and the first pressing end, and the second pressing end and the second guide end being free ends.

* * * * *